United States Patent [19]

Akisue et al.

[11] Patent Number: 4,551,182

[45] Date of Patent: Nov. 5, 1985

[54] PROCESS FOR PRODUCING DEEP-DRAWING COLD ROLLED STEEL SHEETS AND STRIPS

[75] Inventors: Osamu Akisue; Teruaki Yamada; Shigeru Ueda, all of Hyogo; Yoshikuni Tokunaga; Masato Yamada, both of Aichi, all of Japan

[73] Assignee: Nippon Steel Corporation, Tokyo, Japan

[21] Appl. No.: 437,027

[22] Filed: Oct. 27, 1982

Related U.S. Application Data

[63] Continuation-in-part of Ser. No. 418,544, Sep. 15, 1982, abandoned.

[30] Foreign Application Priority Data

Sep. 18, 1981 [JP] Japan ..... 56-147592

[51] Int. Cl.[4] ..... C21D 8/04

[52] U.S. Cl. ..... 148/12 C; 148/12.4

[58] Field of Search ..... 75/126 M; 148/12 C, 148/12 D, 12 F, 12.3, 12.4, 36, 142, 144

[56] References Cited

U.S. PATENT DOCUMENTS

| | | | |
|---|---|---|---|
| 3,988,173 | 10/1976 | Kawano | 148/12 C |
| 4,145,235 | 3/1979 | Gondo et al. | 148/142 |
| 4,331,488 | 5/1982 | Sudo et al. | 148/36 |

FOREIGN PATENT DOCUMENTS

| | | | |
|---|---|---|---|
| 2603097 | 7/1976 | Fed. Rep. of Germany | 75/123 M |
| 2480311 | 10/1981 | France | 148/12 C |
| 137021 | 11/1978 | Japan | 148/12 C |
| 104417 | 8/1979 | Japan | 148/12 C |
| 24952 | 2/1980 | Japan | 148/12 C |
| 107732 | 8/1980 | Japan | 148/12 C |
| 3656 | 1/1981 | Japan | 148/36 |
| 62926 | 5/1981 | Japan | 148/36 |
| 69358 | 6/1981 | Japan | 148/12 F |

*Primary Examiner*—Peter K. Skiff

*Attorney, Agent, or Firm*—Cushman, Darby & Cushman

[57] ABSTRACT

Disclosed is a process for producing titanium-containing cold rolled steel sheets and strips which can stand very severe press forming, which process comprising hot rolling, coiling at a temperature not lower than 700° C., cold rolling and continuous annealing at a temperature, from 700° to 900° C., for 20 seconds to 2 minutes.

5 Claims, 1 Drawing Figure

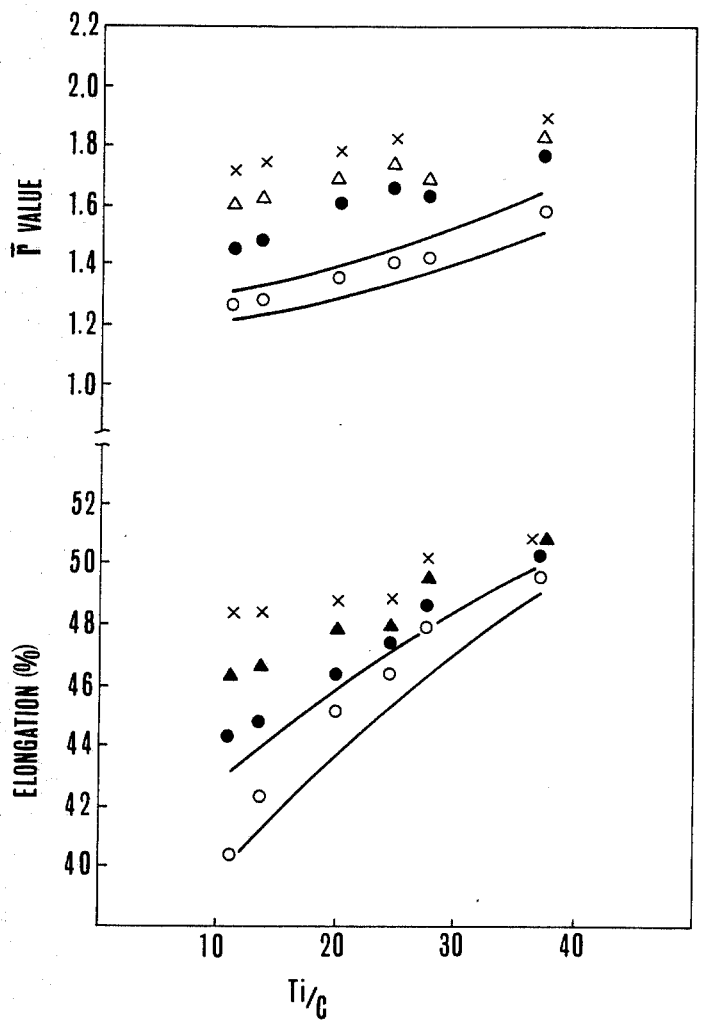
2.2
2.0
1.8
1.6
1.4
1.2
1.0
$\bar{r}$ VALUE
52
50
48
46
44
42
40
ELONGATION (%)
10
20
30
40
Ti/C

PROCESS FOR PRODUCING DEEP-DRAWING COLD ROLLED STEEL SHEETS AND STRIPS

CROSS REFERENCE TO RELATED APPLICATION

This application is a continuation-in-part of our copending application Ser. No. 418,544 filed Sept. 15, 1982, now abandoned.

BACKGROUND OF THE INVENTION

1. Field of the Invention

The present invention relates to a process for producing titanium-containing cold rolled steel sheets and strips (hereinafter called steel strips) which can stand very severe press forming.

2. Description of Prior Arts

Up-to-now many inventions have been made regarding press forming cold rolled steel strips per se and processes for producing such strips.

For production of non-ageing steel strips with improved drawability by continuous annealing, it is known, as disclosed in Japanese Patent Publication No. Sho 50-31531, to add aluminum and then titanium to a molten basic steel composition containing 0.001–0.020% carbon and 0.30 to 0.60% manganese, so as to maintain the sol.Al content not less than 0.01% and the Ti/C ratio not less than 4 to obtain a steel slab having good surface quality, and to subject cold rolled steel strip obtained form the slab through hot rolling, acid-pickling and cold rolling to continuous annealing by heating the strip in the temperature range of from 750° C. to $Ac_3$ point with a heating rate not less than 500° C./hr., holding the strip at this heating temperature for not longer than 300 seconds.

However, this prior art adopts a low temperature coiling in the hot rolling and has a disadvantage that a high degree of drawability, particularly the $\bar{r}$ value and the elongation, cannot be obtained without a relatively high level of titanium content.

SUMMARY OF THE INVENTION

The present invention is characterized in that in the hot rolling step the coiling is performed at high temperatures not lower than 700° C. and the resultant steel strips show the highest grade of material quality.

The process according to the present invention comprises:

(1) hot rolling a steel containing 0.001–0.015% carbon, 0.010–0.100% aluminum and titanium in amounts not less than 4 times of the carbon content but within a range of from 0.015–0.15% with the balance being iron and unavoidable impurities;

(2) coiling the hot rolled strip thus obtained at a temperature not lower than 700° C.; and (3) subjecting the coiled strip to a cold rolling and then a continuous annealing including a soaking step in a temperature range of from 700° to 900° C. for 20 seconds to 2 minutes.

DETAILED DESCRIPTION OF THE INVENTION

The present invention will be described in more details.

Limitations on various elements in the steel composition used in the present invention as well as various treating conditions defined in the present invention will be described hereinbelow.

Carbon, when contained in amounts exceeding 0.015% will increase the amount of TiC formed in the steel, thus considerably raising the recrystallization temperature of the resultant strips. Therefore, in principle, a lower carbon content is more desirable, but in practice it is difficult to keep the carbon content lower than 0.001% in ordinary steel making furnaces. For these reasons, the carbon content is limited to the range of from 0.001 to 0.015% in the present invention.

Aluminum is an essential element for deoxidization of steels, and aluminum contents less than 0.010% are insufficient for this purpose, but it is not necessary to maintain the aluminum content in amounts exceeding 0.100%.

Titanium reacts with carbon, oxygen, nitrogen, sulfur, etc. in the steel and therefore, the titanium content must be determined in view of these elements. With respect to the carbon content, the titanium content must be in amounts not less than 4 times of the carbon content mentioned above. In view of normal levels attainable in a conventional steel making furnace with respect to nitrogen, sulfur and oxygen as impurities ($N<0.007\%$, $S<0.03\%$, $O<0.02\%$), it is necessary to maintain the titanium content not less than 0.015% for the purpose of achieving a high degree of press-forming quality. However, titanium contents exceeding 0.15% will merely increase the production cost without substantial advantages.

Regarding the manganese content, there is no specific limitation in the present invention and manganese content not higher than 1.0% which are normally present in ordinary cold rolled steel strips are satisfactory for obtaining the desired results of the present invention. However, it is desirable not larger than 0.20% Mn is contained for super deep-drawability.

According to the present invention, steels having the chemical composition as defined above are processed into slabs by the conventional continuous casting or ingot-breakdown process, and the slabs are hot rolled with a coiling temperature not lower than 700° C.

By this high-temperature coiling, it is made possible to easily assure a steel material quality which can stand severe press forming despite a short-time continuous annealing.

Subsequently, the hot rolled strip is acid-pickled and cold rolled. In the cold rolling, it is desirable to give the strip a reduction ranging from 70 to 85% for improving the $\bar{r}$ value property which is essential for the desired press forming property.

The continuous annealing in the present invention is performed under the conditions as defined hereinbelow.

The soaking is performed in the temperature range of from 700° to 900° C. for 20 seconds to 2 minutes, because a soaking lower than 700° C. and shorter than 20 seconds will not produce sufficient recrystallization and grain growth, thus failing to provide the desired press forming property. On the other hand, a soaking exceeding 900° C. will produce an excessive degree of austenization, thus lowering the $\bar{r}$ value essential for the drawability. Although a long time of soaking may be used, the soaking time is limited to 2 minutes from the economical point of view.

In the case of titanium-containing cold rolled steel strips, the cooling rate after the completion of soaking does not have influence on the resultant material quality. Therefore, there is no specific limitation regarding the cooling method and cooling rate.

By the combination of the hot rolling conditions with steel compositions and the continuous annealing conditions as defined hereinbefore, it is possible to produce cold rolled steel strips having a high degree of deep-drawability.

Meanwhile, even with high-strength cold rolled steel strips containing P, Mn, Si, etc. a high degree of deep-drawability can be obtained if a high-temperature coiling at a temperature not lower than 700° C. is performed in the hot rolling, and the continuous annealing is done under the conditions defined in the present invention.

BRIEF EXPLANATION OF THE DRAWING

The drawing is a graph showing the relation between the Ti/C ratio, the elongation and the $\bar{r}$ value of the resultant steel strips hot rolled with various coiling temperatures.

DESCRIPTION OF PREFERRED not lower than 700° C. show an elongation value more than 50%.

Thus, according to the present invention, by the high-temperature coiling at temperatures not lower than 700° C. performed in the hot rolling, it is possible to obtain a material quality equivalent to super-deep-drawing grades. Also, as the Ti/C ratio lowers, the improvement of elongation produced by the high temperature coiling is greater and the absolute value of $\bar{r}$ is also high.

This indicates that the addition of titanium can be decreased by the high-temperature coiling of not lower than 700° C.

For this purpose, (1) the strip may be coiled at high temperatures by a coiler close to the finishing rolling mill, or (2) the strip, coiled at an ordinary coiling temperature, may be reheated to a temperature not lower than 700° C. on a separate line. These alternative procedures can also give a similar result.

As understood from the foregoing descriptions, the present invention has a great advantage that deep-drawing cold rolled steel strips can be easily produced by a continuous annealing.

TABLE

| Test Piece Designation | Chemical Composition (%) | | | | | | | | Continuous Annealing Condition | |
|---|---|---|---|---|---|---|---|---|---|---|
| | C | Mn | P | S | sol.Al | T.N | Ti | Ti/C | Soaking Temperature | Cooling Conditions |
| A | 0.0030 | 0.20 | 0.015 | 0.011 | 0.044 | 0.0025 | 0.019 | 6.3 | 775° C. × 30 seconds | 10° C./sec. down to 675° C. 100° C./sec. below 675° C. |
| B | 0.0031 | 0.16 | 0.022 | 0.011 | 0.054 | 0.0038 | 0.034 | 11.0 | | |
| C | 0.0025 | 0.15 | 0.020 | 0.012 | 0.046 | 0.0036 | 0.034 | 13.6 | | |
| D | 0.0017 | 0.15 | 0.020 | 0.012 | 0.043 | 0.0036 | 0.034 | 20.0 | | |
| E | 0.0017 | 0.16 | 0.013 | 0.008 | 0.040 | 0.0021 | 0.042 | 24.7 | | |
| F | 0.0017 | 0.09 | 0.011 | 0.013 | 0.032 | 0.0019 | 0.047 | 27.6 | | |
| G | 0.0014 | 0.13 | 0.013 | 0.012 | 0.042 | 0.0028 | 0.052 | 37.1 | | |

EMBODIMENTS

The present invention will be better understood from the following description of preferred embodiments made with reference to the accompanying drawing.

Steels having chemical compositions shown in the Table were hot rolled and coiled at temperatures ranging from 580° to 830° C., cold rolled to 0.8 mm in thickness, annealed with the continuous annealing cycles shown in the Table, and then temper rolled with 1.0% reduction. The resultant steel strips were tested for their material qualities. The results are shown in the drawing. In the drawing, the coiling was done at the following various temperature ranges.

X=785°-830° C.
Δ=735°-765° C.
•=700°-730° C.
O=580°-620° C.

As clearly understood from the test results shown in the drawing, the steel strips coiled at temperatures not lower than 700° C. show remarkable improvements in the $\bar{r}$ value and the elongation as compared with the strips coiled at a temperature lower than 700° C. Particularly the strips with the Ti/C ratio of 27.6, coiled in the temperature range of from 785° to 830° C. show an elongation value more than 50%, and similarly the strips with the Ti/C ratio of 37.1, coiled at temperatures

What we claim:

1. A process for producing deep-drawing cold rolled steel strips, comprising:

hot rolling a steel consisting essentially of 0.0014–0.0031% carbon, 0.010–0.100% aluminum and titanium in amounts not less than 4 times the carbon content, but within a range of from 0.019–0.052%, 0.0019–0.0038% nitrogen with the balance being iron and unavoidable impurities;

coiling the hot rolled strip thus obtained at a temperature not lower than 700° C.; and subjecting the coiled strip to cold rolling and then continuous annealing including a soaking step in a temperature range of from 700° to 900° C. for 20 seconds to 2 minutes.

2. A process according to claim 1 in which the cold rolling is done with a reduction ranging from 70 to 85%.

3. A process according to claim 1 in which the coiling of the hot rolled steel strip is done at an ordinary temperature and the strip thus coiled is reheated to a temperature not lower than 700° C. in a separate line.

4. A process according to claim 1 wherein the titanium is not less than 6.3 times the carbon content.

5. A process according to claim 4 wherein the titanium is 6.3 to 37.1 times the carbon content.

* * * * *